US007549375B2

(12) United States Patent
Cook et al.

(10) Patent No.: US 7,549,375 B2
(45) Date of Patent: Jun. 23, 2009

(54) TEMPERATURE RESPONSIVE SAFETY DEVICES FOR MUNITIONS

(75) Inventors: John Cook, Sevenoaks (GB); Lakshman Chandrasekaran, Guildford (GB)

(73) Assignee: Qinetiq Limited (GB)

( * ) Notice: Subject to any disclaimer, the term of this patent is extended or adjusted under 35 U.S.C. 154(b) by 366 days.

(21) Appl. No.: 10/522,490

(22) PCT Filed: Aug. 7, 2003

(86) PCT No.: PCT/GB03/03398

§ 371 (c)(1),
(2), (4) Date: Jan. 26, 2005

(87) PCT Pub. No.: WO2004/015360

PCT Pub. Date: Feb. 19, 2004

(65) Prior Publication Data

US 2006/0054046 A1 Mar. 16, 2006

(30) Foreign Application Priority Data

Aug. 12, 2002 (GB) ..... 0218598.1

(51) Int. Cl.
*F42B 15/36* (2006.01)
*F42B 15/38* (2006.01)

(52) U.S. Cl. ..... 102/377; 102/481; 89/1.812

(58) Field of Classification Search ..... 102/377, 102/481, 340, 351, 357, 489; 89/1.801, 1.806, 89/1.812; 60/223; 411/82.5
See application file for complete search history.

(56) References Cited

U.S. PATENT DOCUMENTS 4,035,007 A 7/1977 Harrison et al.

(Continued)

FOREIGN PATENT DOCUMENTS

DE 3007307 7/1981

(Continued)

OTHER PUBLICATIONS

Search Report from the UK Patent Office for Application No. GB 0218598.1.

(Continued)

*Primary Examiner*—Troy Chambers
(74) *Attorney, Agent, or Firm*—McDonnell Boehnen Hulbert & Berghoff LLP

(57) ABSTRACT

The invention comprises devices for mitigating the explosive reaction of a munition when it is subject to an external thermal hazard threat. The devices are based on the use of shape memory alloys. In one arrangement there is device which consists of a connector that is at least in part formed from a shape memory alloy, which typically undergoes large dimensional changes when heated or cooled through a particular transition temperature range. The connector in this invention is designed to form a locking engagement, between two components of a munitions casing at one temperature, but when subjected to external heating through the transition temperature range will deform to allow the connector to disengage and thus release the two joined components, allowing any build up of pressure to be released quickly. Advantageously if the co-operative parts of the connector and components are threaded portions, then the locking engagement will be capable of being dismantled during normal servicing of the munition. The co-operative parts of the connector may be integral with the components to be connected. In another arrangement the device is an annulus and is located around a munitions casing such that upon heating through its transition temperature range will cause the annulus to contract, thereby rupturing the munitions casing, allowing any build up of pressure to be released quickly.

18 Claims, 5 Drawing Sheets

U.S. PATENT DOCUMENTS

| | | | | |
|---|---|---|---|---|
| 5,060,470 | A | 10/1991 | Vanname | |
| H1144 | H * | 3/1993 | Cherry et al. | 60/39.1 |
| 5,394,803 | A * | 3/1995 | Mort | 102/377 |
| 5,735,114 | A * | 4/1998 | Ellingsen | 60/39.1 |
| 6,019,025 | A * | 2/2000 | St. Amand | 89/1.817 |
| 6,321,656 | B1 * | 11/2001 | Johnson | 102/377 |
| 6,450,725 | B1 | 9/2002 | Roth et al. | |
| 7,051,511 | B2 * | 5/2006 | Prytz | 60/223 |
| 2004/0244358 | A1 * | 12/2004 | Prytz | 60/223 |
| 2005/0115443 | A1 * | 6/2005 | Rastegar et al. | 102/400 |

FOREIGN PATENT DOCUMENTS

| | | |
|---|---|---|
| EP | 0 310 369 | 4/1989 |
| EP | 0 334 731 | 9/1989 |
| EP | 0 738 869 | 10/1996 |
| EP | 0 004 696 | 10/1997 |
| FR | 2 686 410 | 7/1993 |
| FR | 2 742 221 | 12/1995 |
| GB | 2 352 768 | 2/2001 |
| JP | 05099377 | 4/1993 |
| JP | 05322074 | 12/1993 |
| JP | 08-189510 | 7/1996 |
| JP | 2000-106060 | 4/2000 |
| WO | WO 90/12237 | 10/1990 |
| WO | WO 02/03019 | 1/2002 |

OTHER PUBLICATIONS

International Search Report from the European Patent Office for Application No. PCT/GB03/03398.

* cited by examiner

TEMPERATURE RESPONSIVE SAFETY DEVICES FOR MUNITIONS

The present invention relates to the use of shape memory alloys in the construction of devices, which are designed to disengage two components on being heated to a predetermined temperature. A particular application for the device is to a munitions casing in order to help avoid or at least to mitigate an explosive reaction when such munitions are inadvertently exposed to fire or some other source of heat.

By the term "munitions" as used hereinafter is meant a bomb, warhead or rocket motor or any similar device which contains a gun propellant, a rocket propellant or an explosive or other energetic material housed within a casing.

The present invention is concerned particularly with the use of shape memory alloys (SMAs) as providing means for mitigating against the violent explosive reaction of a munition when it is heated to the ignition temperature of the energetic material. The most extreme condition occurs when the rate of heating is very slow, the so-called "slow cook-off" condition. Under these circumstances, the whole munition reaches an almost uniform temperature so that the casing surrounding the energetic material is unlikely to lose very much strength before the point at which the energetic material finally ignites. At this point there is a rapid pressure build-up and a high order explosion or even a detonation occurs. Faster heating, which occurs for example when the munition is exposed to a fuel fire (a so-called "fast cook-off" condition) is less hazardous and easier to counter. In this situation, because the flow of heat is from the outside of the munition to the inside, the casing will reach a higher temperature than the energetic material and so will weaken before the energetic material ignites. It is possible to enhance this effect by choice of case materials and by the use of thermal insulation (which is usually needed anyway) between the case and the energetic material. Although the present invention is concerned with mitigating both fast and slow cook-off, the emphasis is on the latter because of the lack of alternative measures for meeting this situation.

There have been a number of disasters over the last 40 years, involving ships, magazines and weapon storage depots in which much loss of life and military equipment have been incurred. Alarmingly many of them have occurred during peace time, and, of those that have occurred in wartime, many have not been the result of enemy action Slow cook-off events have typically occurred where there is a fire in a compartment next to a magazine, which burns for many hours with the result that the magazine heats up slowly and all the explosive stores within it increase in temperature very slowly and uniformly. Therefore, when the first particle of energetic material reaches its spontaneous ignition temperature (T of I), probably in the range 125° C. to 200° C., the remainder is also on the verge of igniting. Furthermore, at that temperature the munition casings would retain nearly all of their strength, particularly if they were made of steel. The result can be a high order explosion that can, for example, destroy a ship. Two famous examples of disasters initiated by fires are HMS Sheffield in the Falklands War and the USS Forrestal in the Vietnam War, both of which resulted in large casualties and loss of platforms and systems and munitions.

As a result of these and other incidents, the subject of Insensitive Munitions (IM) has become an important one in the design, procurement, storage and deployment of any weapons system that employs propellants or explosives, that is most weapons. There is now a general requirement to design main charges, booster charges, explosive trains, rocket motors and gun propellant charges such that when exposed to a disruptive threat they respond as benignly as possible. Therefore, ideally they should give rise to a burning reaction, rather than a high order explosive event or a detonation. In this way it is hoped to avoid the generation of a shockwave or of damaging fragments that would adversely affect other weapons stored in the proximity. By so doing, the hope is that fratricidal events or "chain reactions" can be avoided.

One way to achieve such IM status is to develop propellants and explosives that are relatively insensitive to shock and fragment attack and much work has been carried out on this over the last 25 years, with new generations of energetic materials emerging, albeit slowly.

Another approach is to design the hardware items, i.e. rocket motor or warhead casing, so that when they are attacked they break open readily and do not allow a rapid pressure build-up that might lead to a detonation or high order explosive event. To some extent, it is difficult to reconcile this requirement with the need to withstand rough handling. Nevertheless some satisfactory compromise solutions have been achieved.

There are several standard IM tests, of which three of the most commonly used are:

Bullet or fragment impact

Fuel fire (so-called fast cook-off)

Slow cook-off (SCO)

These tests are designed to replicate the common threats that may cause premature, unwanted, detonation of munitions. Methods have been devised for combating the first two of these threats, but mitigating against slow cook-off has remained an intractable problem.

Previously a number of methods have been suggested for attempting to mitigate against premature detonation of munitions under slow cook-off conditions. These have included:

1. The use of line cutting charges on the outside surface of the case, and pointing inwards. Used in association with an appropriate sensor, it can be arranged for such a charge to cut a slit in the case just before the propellant ignites.
2. Thermite blocks have also been used to achieve a similar result by burning a hole in the case.
3. Low melting alloys or polymer compositions have been considered as a means of greatly reducing the strength of a joint when subject to heat.

None of these methods has proved particularly successful whether applied to rocket motor cases or to other types of munition. The first two methods are considered as active mitigation methods, which involve the use of additional energetic materials on the body of the weapon, which can introduce a further set of hazards making them an unattractive solution. The third method is referred to as passive mitigation. However, the problem encountered with this type of passive mitigation, using low melting materials, is trying to achieve sufficient strength under normal firing conditions. At the same time it is necessary to ensure that most of the strength has been lost at the lowest possible propellant ignition temperature. For a double base propellant this temperature can be as low as 125° C. An alternative method, by which a low melting point material is used as a fusible plug, is inadequate because it cannot be used to create a large enough aperture for the gaseous products from the propellant or explosive to vent sufficiently quickly.

Shape memory alloys are metal alloys that undergo large dimensional changes when heated or cooled through a particular transition temperature range. Shape memory alloys exhibit two distinct crystal structures or phases below and above the transition and the mechanical properties of the alloy are different in the two phases. Therefore, upon heating or cooling the alloy, a transition temperature range is reached over which range the crystal phase changes and the alloy will adopt the properties of the new crystal phase. In general, the "memory" is imparted to the SMA by deforming it, usually in the lower temperature state. Therefore a ring which is intended to expand on heating through its transition temperature range would previously have its memory imparted at a lower temperature by compressing it radially. Whereas, a ring intended to shrink on heating would have the memory imparted by stretching. An SMA material is said to exhibit one way memory if the shape change achieved by plastic deformation at a lower temperature is annulled on heating and the deformed shape is not restored on subsequent cooling. By contrast SMA materials which can be made to alternate between a low temperature shape and a high temperature shape throughout a number of heating and cooling cycles are said to exhibit the two-way shape memory. Both types of shape recoveries are possible in most of the SMAs. However the extent of reversible shape recovery associated with two-way shape memory in any SMA is usually less than that associated with one-way memory. In general, though, unlike low melting point metal alloys, which are mechanically weak, SMAs have mechanical properties that are comparable with those of engineering materials such as light alloys and steels and are therefore ideally suited to high stress and strain applications. The transition temperature for the shape change can be selected by the appropriate choice of composition of the SMA.

The one way recovery strain achievable is in the range 2% to 6% in Ti—Ni based SMAs and in the range 1% to 4% in Cu—Al based SMAs. In general, the highest recovery strains are achievable in rings or tubes to which the memory is imparted by stretching in a radial direction and which then shrink to their original dimensions on heating. In the reverse mode, where the memory is imparted by compression and the component expands on heating, the effect is somewhat smaller, but nevertheless large enough to be usable.

A tube manufactured from a shape memory alloy which is designed to expand radially upon heating will usually contract in length at the same time, as the overall volume of the shape memory alloy remains substantially constant. Likewise, if the tube is designed to contract radially, this will lead to a concomitant expansion along the axis. For the purposes of the current invention, it is also significant that many shape memory alloys will generate high recovery strains on activation, even when their movement is opposed by large resistive forces.

Such tubes can be manufactured by machining from rod, forging or extrusion, alternatively; for large diameter tubes it may be more convenient to select SMA alloy sheets of appropriate thickness, wrap them around suitable mandrels to achieve cylindrical shapes and weld the joints to produce SMA tubes. In the latter case there may be some loss of SMA function at the weld interface, but the remaining SMA will give the required expansion or contraction on heating.

U.S. Pat. No. 6,321,656 discloses the use of shape memory alloys to mitigate against slow cook-off in relation to rocket motors. The patent describes three embodiments of the invention as applied to a rocket motor case, which is in two sections. A first section has a small number of prongs each with a small lug at its tip and the second section has an equal number of recesses for location of the lugs. When the two sections are brought together in an end to end manner the lugs engage with the respective recesses by virtue of the prongs on the first section being biased so as to cause each associated lug to lock with its respective recess in the second section. In a first embodiment of the invention, a shape memory alloy ring, which is of an alloy composition such that upon heating it will contract, is located tightly around the prongs. Upon heating, in a thermal hazard incident, the shape memory alloy ring contracts, pushing the prongs inwards and therefore causing the lugs to move out of their respective recesses allowing the two sections of the motor case to disengage and so to vent any built up pressure. In a second embodiment, the shape memory alloy ring is placed on the inside of the prongs on the first section, and is expanded so as to force the prongs into engagement with their corresponding recesses. On heating the ring retracts to its annealed size thereby allowing the prongs on the inner section to move inwards away from engagement with the respective recesses in the outer section. In the third embodiment, the first section is slightly modified to allow the location of two shape memory alloy rings, one around the outside and one on the inside of the pronged section, thus providing the combined effects of the first and second embodiments, such that upon heating both rings contract inwards, to give the same overall effect.

However, the arrangement shown in the U.S. patent suffers from the disadvantages that once the ring or rings have been put into position, they cannot be easily removed without heating the device. It is common practice for munitions to be regularly serviced and monitored during their service life and so a non-reversible system such as this would not be an ideal solution. Another disadvantage is that the pronged section produces an internal projection into the volume where the propellant is located. This results in difficulties for loading the propellant when in cartridge form into the rocket casing and means that the propellant would most likely have to be melt cast. A further disadvantage of the arrangement shown in this U.S. patent is that the shape memory alloy has to be heat treated to enable the connection means to be installed. In addition, as the whole of the axial load arising from the pressurisation of the case has to be carried through the prongs and lugs, the arrangement is structurally inefficient. Finally, the shape memory alloy ring in this arrangement is not an integral part of the connection system, thus adding to the complexity of the arrangement and hence the cost of manufacture.

Accordingly it is an object of the present invention to provide an arrangement where the casing of a munition that might be subject to a slow cook off situation is caused to disrupt so as to avoid an unwanted detonation of the munition, but whereby the arrangement does not prevent routine disconnection or disassembly of the rocket casing. A further object is to provide a means of disruption which is an integral part of the connection for a munition casing making construction simpler and the casing easier and cheaper to manufacture.

Although this invention is primarily concerned with means for mitigating the effect of slow cook off in relation to munitions it is also recognised that connectors according to the invention may be appropriate for use in other situations. One such area is for the connection of pipes or containers involved in the carrying or storage of fluids such as natural gas. In the event of a heating hazard the gas could become highly pressurised, which could cause an explosion. However, the (controlled) release of such a fluid would prevent a violent explosion. The connector in the invention should not be seen however to be limited to use in conjunction with flammable or combustible fluids as any pressurised fluid can present a hazard. Normally the use of such a connector would be in conjunction with other safety mechanisms.

A further use for these connectors would be for the joining and easy release of structural components such as pipes or as for example those used in the construction of oil rigs and which need to be dismantled at the end of their useful life. The underwater support columns of oil-rigs are sometimes cut with explosive charges, but this has adverse effects on marine life. However if these columns were provided with connectors according to the invention, then, at the end of their service life the connectors could be heated (e.g. by a thermal jacket), which would allow the structure to be released and relocated. This could be accomplished without the expense and environmental danger involved in the use of high explosives. Similar arrangements might be contemplated for dismantling of other structures which are difficult and possibly hazardous to access, such as nuclear power stations or chemical manufacturing plants. However, in all these cases consideration would have to be given to situations in which the structures may experience severe temperatures i.e. in a fire hazard situation. Under these circumstances a temperature responsive connector activated by heating would only be appropriate if it could be satisfactorily insulated as otherwise the integrity of the structure might be compromised. An alternative approach to this would be to employ a temperature responsive connector that was induced to disengage by cooling it to a temperature that could never be experienced in normal service (e.g. −50° C.).

According to a first aspect of the present invention therefore, there is provided a connection means for joining together separate components to form a unified body wherein locking engagement can be provided between an integral operative part of said connection means and an integral co-operative part of at least one of said components wherein either or both of the operative and co-operative parts is or are made of a shape memory alloy which occupies a first configuration at a first temperature and undergoes a change of shape when brought to a second temperature to afford a second configuration, said operative and co-operative parts providing locking engagement at the first temperature and allowing release from said locking engagement at the second temperature.

Typically, the operative part of the connection means will comprise a compression fitting, a snap-type of fitting or will involve the use of threaded portions, co-operating with appropriate portions on one or more of the components. The choice of connection means would be dependent on the nature of the two components to be joined and the nature of the situation which the connector is intended to cope with, also whether or not it was desired that the connections should be reversible. The parts made from a shape metal alloy may be pretreated if desired in order to impart a shape memory to the material.

The connection means may form a separate structural and load bearing part between the two components or may form an integral part of either one or both of the components in which said component or components is either wholly formed of a shape memory alloy or has a shape memory alloy insert which forms at least the operative part of the connection means. Furthermore the co-operative parts may both be formed from SMAs wherein one part is designed to expand upon heating and the other part is designed to contract upon heating, therefore affording an increased degree of disengagement. The connection means may be arranged to be either permanent or reversible such that it can be unfastened without being subjected to heat or by cutting or otherwise damaging any of the original components or the connection means, where this is a separate entity. It may readily be appreciated that the connection means may possess more than two operative parts, such as a multi-adapter (T-junction connector), in which the connector and components to be joined would possess mutually co-operating coupling locking means.

The separate components may comprise two or more parts of a munitions casing, particularly a rocket motor casing, but may alternatively comprise two or more pipes or columns, which are to be joined together but where it may be desired to achieve the rapid disconnection of the two sections when subjected to a thermal stimulus. In one scenario the stimulus may be from an external hazard such as a fire, or secondly the stimulus may be controlled heating to induce failure of the connection means to allow the easy disassembly of a structure. Advantageously such failure can be effected at a remote location such as at a depth underwater or in a hazardous environment such as in a nuclear reactor or in space.

In the context of the present invention the first temperature is a temperature within the range in which the alloy possesses one phase structure and the second temperature is a temperature within the range in which the alloy possesses a different phase structure. The transition temperature for a change in crystal phase (and hence shape) therefore lies between the first and second temperatures.

In the connection means according to the current invention the SMA used will typically be selected from Cu—Al alloys, Cu—Al—Zn, Cu—Al—Ni, Cu—Zn—Al—Mn, Cu—Ni—Al—Zn—Mn or Ti—Ni alloys. Other elements may be added to Ti—Ni to adjust the transition temperature or achieve better mechanical properties. These include Nb or Hf in the range of less than 10% and Cr, Fe, or Ce in the range of less than 2%. For the purposes of slow cook-off mitigation, the transition temperature must be higher than the highest temperature incurred in normal service, which may typically be between 50° C. and 110° C., depending on the storage and service conditions, but below the lowest temperature at which slow cook-off can occur. This cook-off temperature can be as low as 125° C. for some classes of propellant but well over 200° C. for some pyrotechnic compositions.

Where the connection means comprises a separate load bearing item not integral with either or both of the components to be joined, it may comprise two or more parts, wherein one or more recessed regions, located either internally or externally on the components, can be used to align and locate with the connection means. In this case the connection means has respectively one or more complementary external or internal projections, which when brought into the correct alignment with the two components will engage with the recesses therein so as to lock the parts together. Clearly the alternative configuration is possible, with the projections located on the components to be joined and the complementary recessed regions formed in the connection means. Other combinations and arrangements of this type will be readily appreciated by the skilled person and are to be understood as coming within the scope of the invention. The projections can take the form of any protrusion such as a tongue, hooked latch, lug, flange or male thread and the complementary recessed region may, for example, be a pocket, channel, groove or female thread.

In a preferred arrangement where the components to be joined are hollow cylinders, the connection means comprises a separate load bearing member comprising two or more parts and having two internal and/or external threaded portions, arranged to interact with complementary threaded portions on each of the components to form the unified body, such as a munitions casing. The threaded portions at least of the connection means are made from a shape memory alloy which when subject to heating will deform causing the threaded portion of the connection means to contract or expand radially (depending on whether the connection means is located inside or outside the component) and hence to bring about simple disengagement of the thread. Alternatively the disengagement may rely on the concomitant expansion or contraction of the SMA threads in a direction parallel to the axis where the relative movement between the SMA and non-SMA threads causes sufficient damage to the threaded portions as to bring about their disengagement. In practice it is likely that the disengagement of the two co-operative parts will be afforded by a combination of these two processes taking place. For the purposes of mitigating a cook-off event it is not necessary to completely disengage the threads. Thus, if radial disengagement occurred to substantially half a thread depth, this would be sufficient as the egress of the gases produced would push the male threaded section to one side relative to the female thread. Therefore there would be full disengagement around part of the periphery of the joint, which would be sufficient to destroy its structural integrity.

In a further variant, both co-operative parts of the connection means may be formed from SMAs and be arranged such that, upon heating or cooling as the case may be, one of the threads expands radially and the other contracts radially, to more readily afford separation of the two.

The invention is primarily concerned with slow cook-off mitigation and can be used in conjunction with any container for any energetic material such as a bomb or shell containing high explosive, a torpedo or missile containing propellant or a pyrotechnic device. Therefore, it has particular application to rocket motors or propellant filled munitions.

In the case of rocket motor casings, during normal operation of a rocket motor, the temperature responsive connector of the invention must have sufficient structural integrity to withstand the internal pressure generated by the burning propellant. At the same time it must be sufficiently well insulated from the hot gases to remain below its transition temperature throughout propellant burn. Normally a rocket motor has internal insulation to ensure that the case remains sufficiently cool to perform its structural role. If a temperature responsive connector is used, some internal insulation may be required that is additional to the amount that would otherwise be needed. Likewise, if the rocket motor is part of a high-speed missile that is subjected to aerodynamic heating, additional external insulation may be needed to prevent activation of the connector. With the connection means of this invention present, having a transition temperature which is substantially lower than the temperature of ignition of the energetic material, the shape memory alloy will adopt its second configuration under slow cook off conditions before the temperature of ignition is reached, thus allowing the connection means to deform and the missile casing to be disrupted, relieving any build up of gas pressure and thereby preventing an explosion.

Another aspect to be considered in the application of the connection means of this invention to mitigation of slow cook off in rocket motor casings is the thermal heating arising in the casing and surrounding structure after the rocket has been fired and the propellant has been consumed. "Heat soak" effects occur whereby heat is transferred from the hotter parts to the cooler parts. The temperature responsive connector, being well insulated, would normally be one of the cooler components, so its temperature would be expected to continue to rise after propellant burn-out. Therefore there is the possibility that the connector may disengage at some later stage in the missile flight causing the missile to break apart. Normally, this would be undesirable, and so the insulation provided would need to be sufficient to ensure that this did not happen. However, there are circumstances in which disengagement of this kind would be desirable. For example, with a multiple stage rocket motor, once the rear part of the missile has performed its role it will only contribute to the drag and in this situation, the heat flow into the temperature responsive connector could be arranged to bring about the disengagement of the component parts of the casing automatically at an appropriate point in flight.

Shape memory alloys may also be used in a way that affords a rupturing action on a munitions casing or other component which is to be disrupted. According to a second aspect of the present invention therefore, there is provided an overwound munitions casing incorporating an annulus of a shape memory alloy which has been subjected to a combination of mechanical and thermal treatments and which has a composition such that upon subsequent heating to a predetermined temperature, said annulus will contract radially inwardly and rupture the said munitions casing.

The annulus may be formed from a solid ring of shape memory alloy or alternatively a plurality of windings of shape memory alloy in wire form. The advantage of the latter is that the wire may be wound directly onto a casing, whereas a solid ring would have to be pre-shaped to fit the surface to which it is to be fitted. Further, windings may be especially useful if the casing has a waisted or tapered section or has an irregular surface area, as the wire will automatically adapt to the contour of the surface during the winding process. Thus, the SMA wire rupturing (device) provides a more versatile cutting tool than the fixed collar.

The SMA is treated by stretching or expanding at a temperature below the predetermined temperature, in order to impart the memory function into the annulus. However in the case where the annulus is in the form of windings, the memory may be imparted by placing the wire under tension during the winding process at a load sufficient to impart memory deformation to the wire, thus reducing the number of processing steps required The annulus may be produced from any suitable shape memory alloy and may for example be selected from Cu—Al—Zn, Cu—Al—Ni, Cu—Zn—Mn—Al, Cu—Ni—Al—Zn—Mn and Ti—Ni alloys. If in wire form the SMA must also be ductile and capable of being drawn into a wire. The selection of the load or work applied to the solid ring or wire will depend upon the alloy selected and the strength of the material which forms the casing to be cut; the higher the load imparted on to the wire the greater the compressive force that can be applied.

The SMA annulus is designed to contract in use upon heating to afford a rupturing or cutting action for example in respect of an overwound rocket motor where the rupturing device acts a mitigation device to prevent an explosion on slow cook-off. Alternatively the element could be a container which is filled with water or a fire dispersing material, wherein the annulus is applied so that when in the presence of a fire the container is cut, releasing the water or dispersing material to douse the fire, In an alternative arrangement the rupturing device may be used in an active system, such that heat is deliberately applied to the annulus to cause it to contract. A simple method of generating internal heat in the SMA wire could be achieved by resistive ohmic heating 99, which could be achieved by either direct application of a current to the SMA annulus or by inducing a current in the annulus to achieve heating. It will be clear to the skilled person that other heating means for both solid and wire annuli may be employed, such as external heating wires or a radiant heater. By careful control of the rate of heating and the total heat applied the concomitant rate of contraction and total force provided by the contraction of the annulus can also be controlled. This allows the user to select the amount of damage or degree of rupturing to the casing that is desired, ranging between merely distorting the component through to actually cutting it open. In the situation where the annulus is being used as a mitigation device it is desirable that the casing is at least split by the action of the annulus so as to effect the necessary release of pressure.

Typically this arrangement may be suitable for any thin walled munitions casing such as lightweight rocket motor tubes or for launch tubes such as are used in man-portable rocket propelled weapons, eg. man-launched anti-tank weapons.

If a contracting SMA wire is to be used to cut a case or tube, it may be desirable to concentrate its effect over as short a length of casing as possible. It will be appreciated that if a wire is wound directly on to a surface it may be difficult to achieve a thick narrow band of material, as the wire may have a tendency to spread. Therefore to concentrate the load it may be desirable to wind the wire into a housing of substantially U shaped form, such that the wire is retained within the housing. The housing shape and more importantly the contact area between the housing and the casing to be cut will affect the pressure applied by the contraction of the wire. The housing is not necessarily required to extend right around the perimeter of the casing to be cut, such that a gap may be left in the housing, for ease of fitting on the casing, however the gap should be sufficient such that as the SMA contracts the gap never closes fully. This ensures that the SMA does not have to devote any of the force it generates to unnecessarily driving the housing into hoop compression, as would be the case if the housing formed a continuous ring. It may further be desirable to incorporate notches in walls of the housing in order to reduce its flexural stiffness, the objective being to avoid the SMA performing unnecessary work in bending the housing, allowing the radially exerted force to be concentrated into cutting the casing.

A complication can arise if the casing is made of a high elongation alloy, such as certain aluminium alloys. The SMA may be able to exert sufficient force to cut the case, but the recovery strain achievable by the SMA may be lower than the strain to failure of the alloy, such that the contracting SMA would form a deep circumferential groove in the casing but would not necessarily cut it. One solution to this is to concentrate the cutting action over only part of the circumference of the casing. This may be achieved by enlarging a portion of the SMA housing by the use of lateral flanges around part of the circumference. The flanges, where used, will spread the load over a wider area of the case. Therefore the cutting action will be concentrated on the remainder of the housing without a flange, thus increasing the cutting efficiency. The selection of the optimum length of "unflanged" housing is a compromise between two considerations. A short arc has the effect of concentrating the effect of the SMA into a short arc, but the cutting may not penetrate very deeply into the casing because the distance between the chord and the arc is small. Thus, as the radius of curvature of the housing increases as it "bites" into the casing, so the radial force it exerts decreases. This mitigates against the use of a very short unflanged length. It will be evident that for a slow cook off mitigation action, a crack running part way around the casing is sufficient, provided the length of the crack exceeds a critical value, as the action of a subsequent pressure build-up is likely to cause the crack to propagate around the circumference and afford the desired pressure reduction.

The approach of using a wire is desirable where the motor tube is thinned ("waisted") on its outer diameter, because with a solid ring it might be impossible to achieve a sufficiently tight fit around the motor for the subsequent cutting action to be effective. As overwinding with fibres is a common method of constructing rocket motor cases, it will be convenient also to include SMA wire within the overwind.

The cutting action of a contracting annulus may be enhanced by the incorporation of a cuffing device. This device may comprise a metal or ceramic spike, blade or sharpened edge 86, which may be mounted in a separate housing 88 to retain and direct it. The cutting device is placed between the annulus and the casing to be cut. Upon contraction of the annulus, the device will be forced radially inwards, cutting into the casing to produce an opening. It will be readily appreciated by a person skilled in the art as to the size of opening required to allow the explosive to be mitigated in any particular munition. The size of cutting device may then be selected to create the desired size of opening. Further, it may also be desirable that the cuffing device, when not in use, is in held a retracted position, such that it is not in permanent direct contact with the casing to be cut. In this way, any weakening or premature rupturing of the tube in normal service is avoided. This retraction of the cutter may be achieved by, for example, placing a sacrificial spacer or a bias means, such as a set of springs between the cuffing device and the casing. Alternatively the cuffing device may be retained by pins, or adhesive, which can be sheared, or caused to fail by other means, by the action of the contracting SMA.

For some types of casing the action of a contracting band on its outside may cause it to buckle before it cracks. Which mode of failure (i.e. cracklng or buckling) occurs first depends on the wall thickness of the casing, its diameter and the modulus and strength of the material from which it is constructed. If the casing is laminated or of a composite construction, this may also affect the failure mode. In the event of buckling occurring, it is possible and desirable to concentrate the buckling action into one deep fold, by any one of the aforementioned techniques. The sharp curvature at the bottom of the fold may then be sufficient to cause the casing to crack. In this situation the type of housing is not as important as it is for cutting and so the SMA may be applied as a broad band.

The SMA based mitigation devices described up to this point are passive in that they respond to the external heating threat without the need for sensors to detect the threat or energy sources to trigger the SMA. When used in this way they have the merits of simplicity and obviate the need for additional energetic materials, which introduce fresh hazards, or power sources such as batteries that introduce lifing and maintenance issues. However, all the configurations described can be converted into active mitigation devices by the use of additional sensors and power sources. In the case of slow and fast cook-off, it might also be desirable to incorporate some kind of electronic logic circuit in order to anticipate the event and activate the SMA accordingly.

Therefore in one embodiment of the invention the SMA device will have a heating means, such as an electrical supply connected. There may also be provided a heat sensing means and a manual activation capability such that one could actively choose to disengage or rupture the munition, as for example when a rocket motor is jammed in an aeroplane or helicopter launch tube, or if the need arose to break up a rocket in mid flight. The SMA device could still function in the normal passive mode, that is when its surroundings reach the SMA transition temperature, but the active mitigation would form an additional option.

The invention will now be further described with reference to the accompanying drawings and example in which:—

Figure 4A:
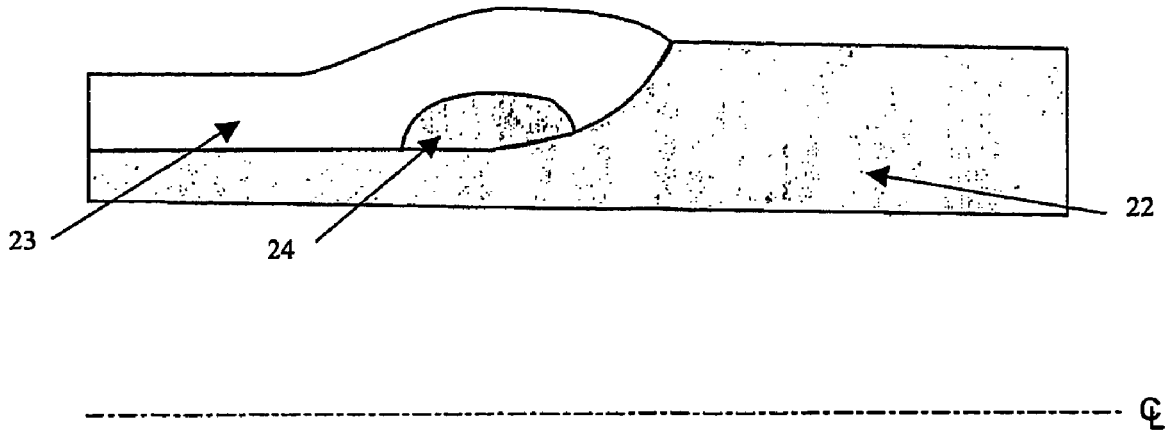
Figure 4B:
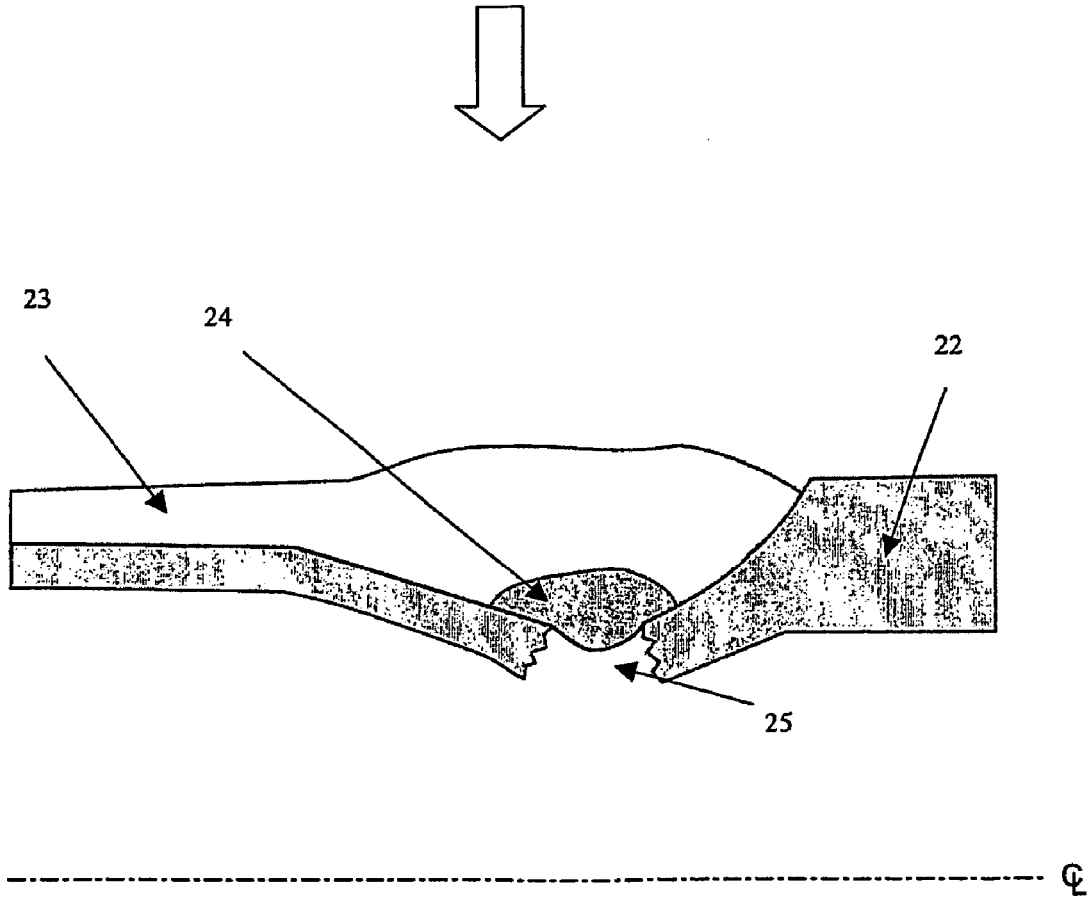
Figure 5:
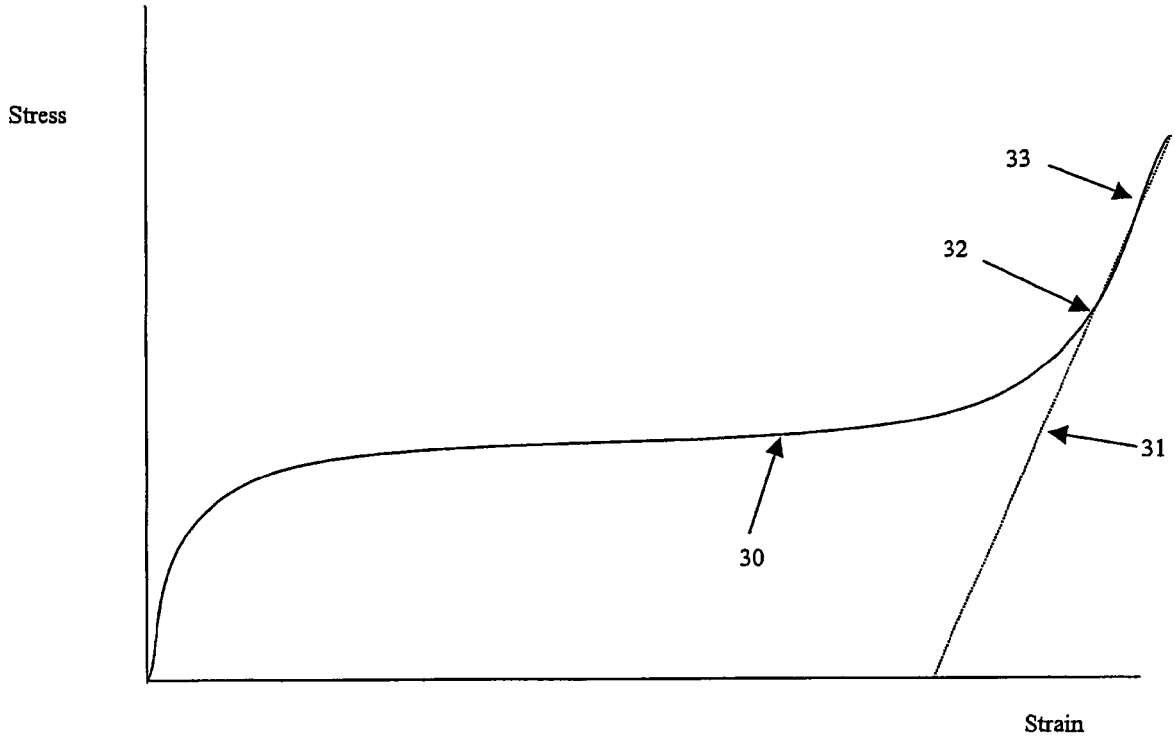
Figure 6:
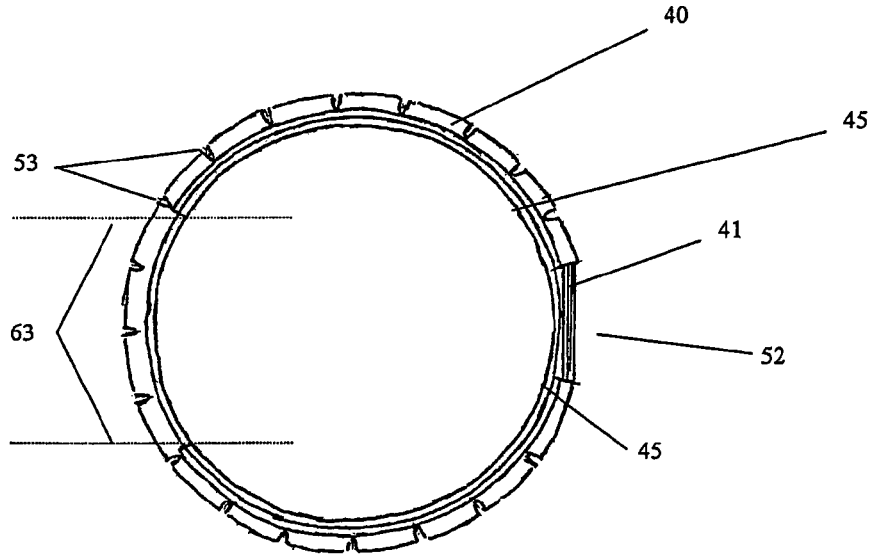
Figure 7:
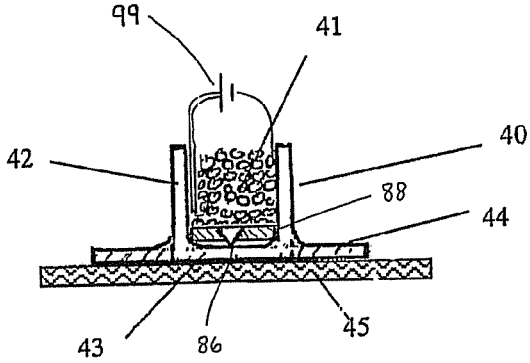
Figure 8:
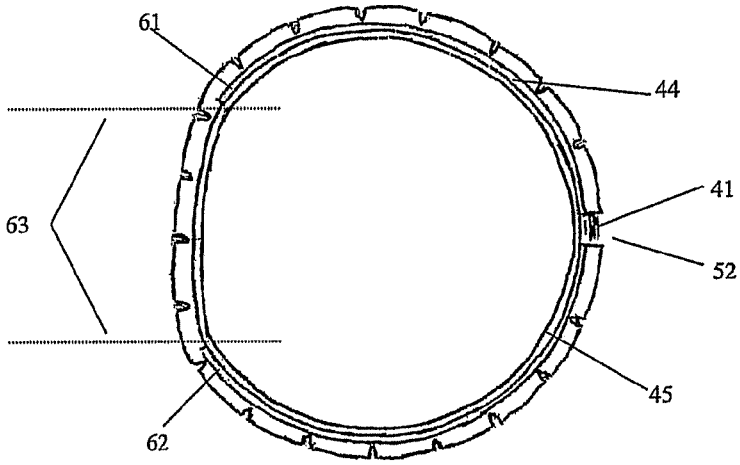

FIGS. 4*a* and 4*b* are longitudinal sections of part of an overwound rocket motor casing where part of the overwinding comprises an SMA wire overwind (4*a* is prior to and 4*b* is the result after activation of the SMA wire);

FIG. 5 is a graph showing a typical stress versus strain plot for an SMA wire material;

FIG. 6 shows a partially flanged housing, for containing the wire windings, in elevation, mounted on a munition casing (shown in cross section), prior to activation;

FIG. 7 is a cross section through the housing of FIG. 6;

FIG. 8 shows the housing of FIG. 6, after activation.

Figure 9:
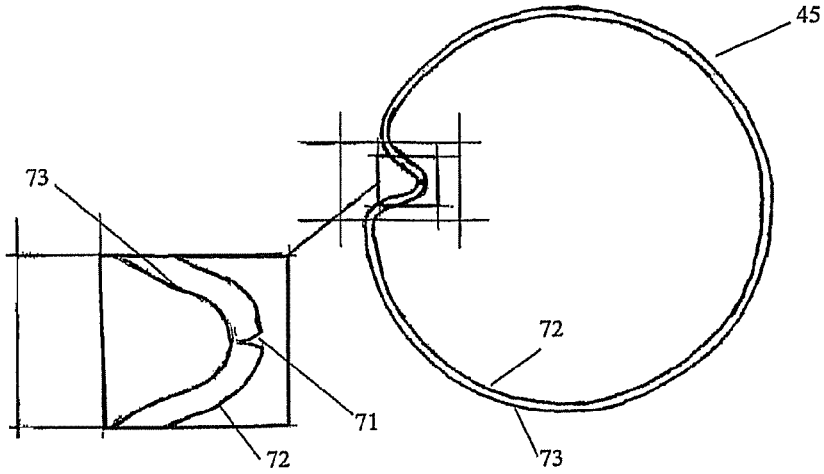

FIG. 9 is a drawing of one mode of rupturing of the casing of a munition, by buckling and cracking due to the action of an annulus of SMA.

Figure 10:
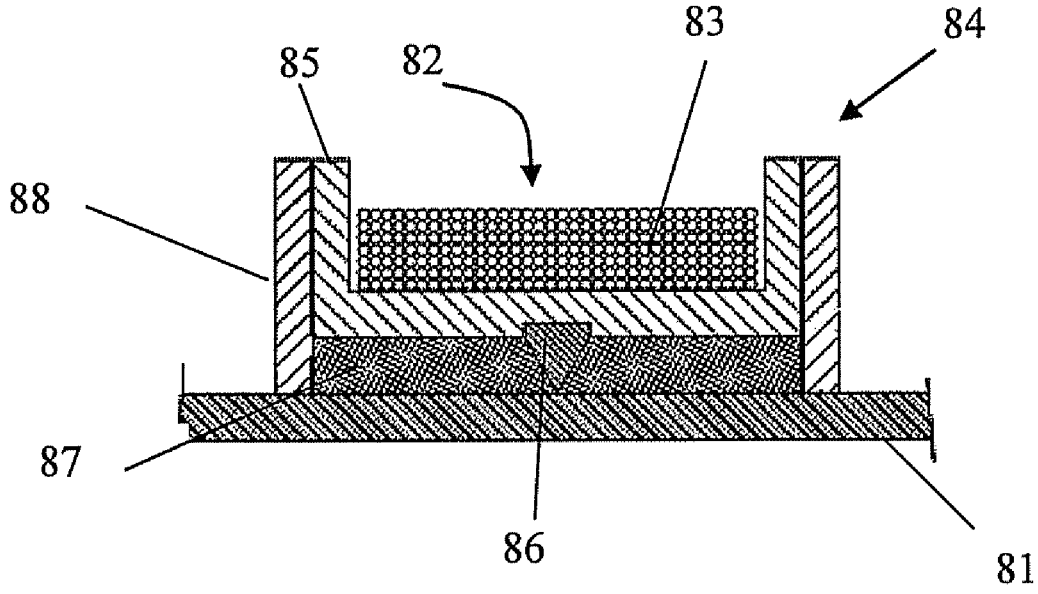

FIG. 10 is a section through housing 85 taken on a plane that is radial with respect to the munition casing 81. The housing (85) is seen to contain a plurality of SMA wire windings (83). The cuffing action of a contracting annulus (82) may be enhanced by the incorporation of a cuffing device (84) as shown in FIG. 10. This device may comprise a metal or ceramic spike, blade or sharpened edge (86). which may be mounted in a separate housing (88) to retain and direct it. Further, it may be desirable that the cuffing device (86). when not in use, is held in a retracted position such that it is not in permanent direct contact with the casing (81) to be cut. In this way, any weakening or premature rupturing of the tube in normal service is avoided. This retraction of the cuffer (86) may be achieved by, for example, placing a sacrificial spacer (87) between the cuffing device and the casing.

Figure 11:
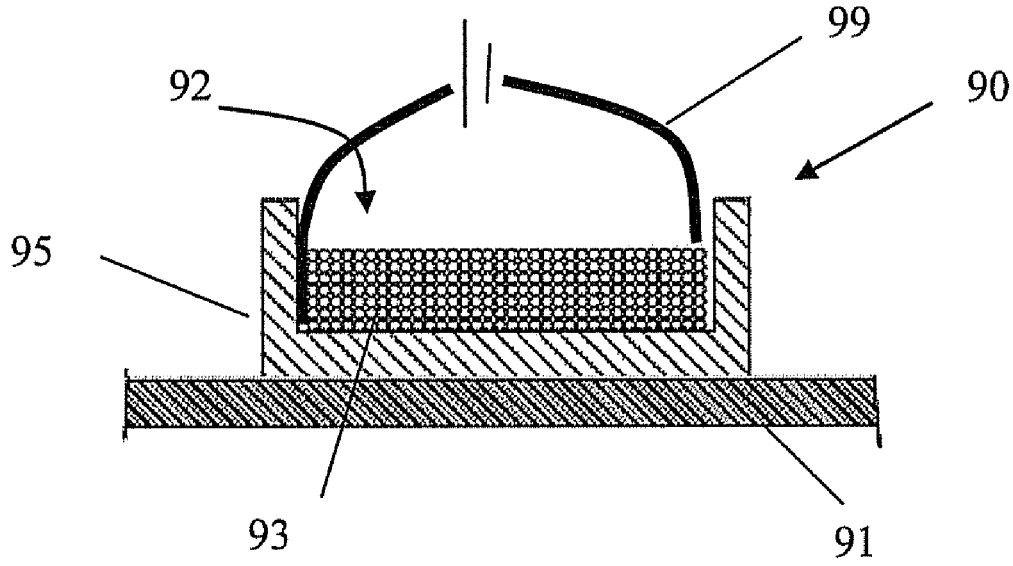

FIG. 11 is a section through housing 95 taken on a plane that is radial with respect to the munition casing 91. The housing 95 is seen to contain a plurality of SMA wire windings 93. In an alternative arrangement the rupturing device 90 may be used in an active system, such that heat is deliberately applied to the annulus 92 to cause it to contract. A simple method of generating internal heat in the SMA wire 93 could be achieved by resistive ohmic heating, which could be achieved by either direct application of a current 99 to the SMA annulus or by inducing a current (not shown) in the annulus to achieve heating.

Figure 1:
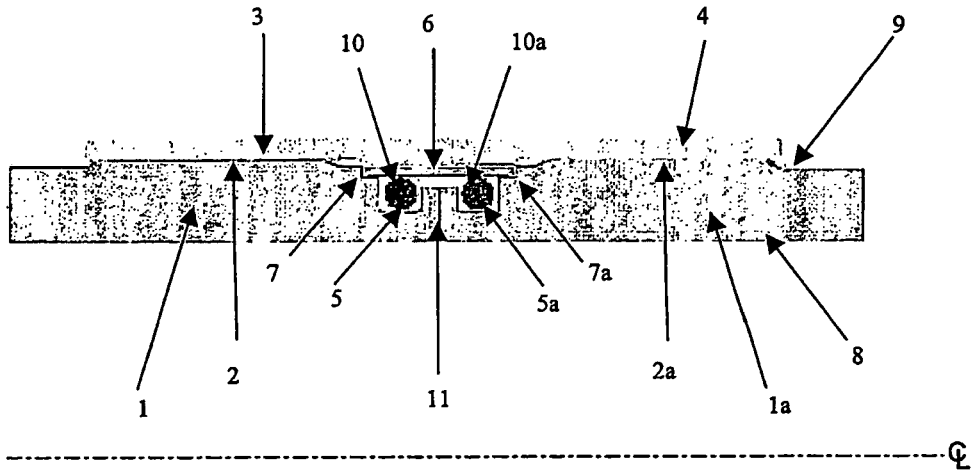
FIG. 1 is a partial cross section through a connection device according to the invention having an internal thread in conjunction with two sections of a rocket motor casing which possess complementary external threads.

In the embodiment shown in FIG. 1 two sections of a rocket motor case are shown at (1, 1*a*). Each has a threaded portion (2, 2*a*) on its outside face. The connection means (4) is an extended annulus of shape memory alloy, having an internal thread (3) which is complementary to external threads (2, 2*a*) on the two sections of rocket motor casing (1, 1*a*). The rocket propellant charge (not shown), will occupy the volume enclosed by the casing. The interface (11) between the two rocket motor sections (1, 1*a*) is reinforced by respective stepped shoulders (7, 7*a*) formed on the outside faces of the casing sections. A metal insert (6), which can be of SMA or any material capable of providing mechanical support, is seated against shoulders (7, 7*a*). Insert (6) may be independent of the connection means (4) or integral with it. To ensure a gas tight seal during normal operation two o-ring seals (10, 10*a*) are located in the channels (5, 5*a*) in the respective casing sections. "Memory" will have been imparted into the SMA during a previous forming operation. For example it may have been passed through a tapered die to reduce its diameter or compressed radially by the application of external pressure.

When subjected to a thermal hazard such that a predetermined temperature is reached, the connection means (4) is arranged to deform, by contraction along its axis plane, causing the internal thread (3) of the connection means to move against and to break the external threads (2, 2*a*) of the two rocket motor sections as a consequence of which the two rocket motor sections will separate and allow the pressure inside the rocket motor to vent. In an alternative arrangement the connector (4) simply expands so as to disengage the threads 3 and 2, 2*a* respectively, again allowing the motor sections to separate, but in practice it is likely that both mechanisms will operate simultaneously. It will be readily appreciated by the skilled person that the connector 4 could possess an external thread, and that it could be located instead on the inside of the two rocket motor sections (1, 1*a*) which in turn would possess complementary internal threads. In this arrangement the connector is designed, on being heated, to contract radially with concomitant expansion in the axial plane, thus again affording disengagement of the threaded portions and separation of the two rocket motor sections.

Figure 2:
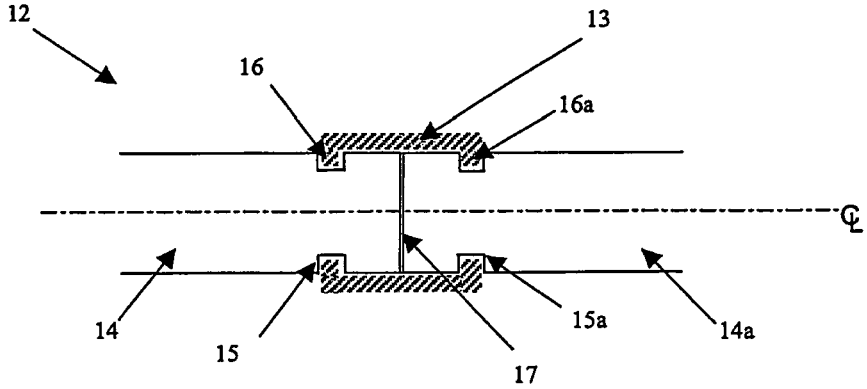
FIG. 2 is a partial cross section through a connection device according to the invention having two or more lugs or alternatively two inwardly-projecting lips at the extremities of the annulus, and shows the device in use to join together two pipes or columns which possess complementary recesses.

In the embodiment shown in FIG. 2, two members (14, 14*a*) which may be cylindrical or of other section and either solid or hollow are to be joined at the interface (17). The connection means (13) is a sleeve of like section to the members having annular projections (16, 16*a*) which locate into respective recesses (15, 15*a*) formed in the members to be joined towards the respective ends thereof. (It will be appreciated that the projections and recesses may equally well be continuous, ie. an upstanding annulus and an annular groove or channel respectively and also that the locations of the recess(es) and projection(s) could be reversed). The connected unit 12 may comprise a part of an oil rig or other structure which it is desired to disassemble remotely at some future time. The connecting sleeve 13 is made from an SMA which is shrunken onto the members and is so chosen that on heating to a predetermined temperature it will expand sufficiently to become disengaged from the members (14, 14*a*) thus allowing them to be separated. It will be readily appreciated by the skilled person that the connecting sleeve can be activated by cooling, which would be more appropriate for any structure that has to meet a fire hazard during service.

Figure 3:
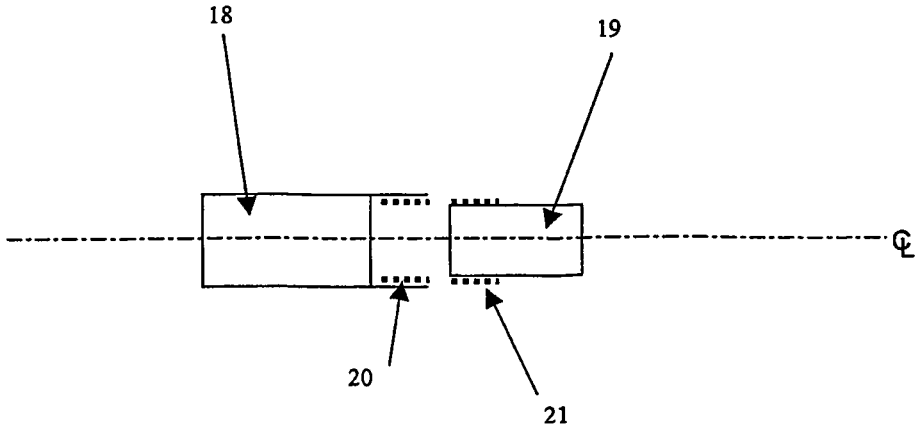
FIG. 3 is a partial cross section through a connector according to the invention, where one pipe to be joined has an internal thread and a second pipe has a complementary external thread.

In the embodiment of FIG. 3 two cylinders 18, 19 (which may be either solid or tubular) are to be joined. In this case the connection means is integrated with the members to be joined. Thus cylinder (18) has an internal threaded section (20), while cylinder (19) has a complementary external threaded portion (21). The two cylinders are brought into engagement by screwing them together. At least one cylinder thread (20, 21) is manufactured from a shape memory alloy and may be an inset or alternatively one or both of the cylinders may be entirely manufactured from a shape memory alloy. When the connection means is either heated or cooled to a predetermined temperature (as desired), at least one operative part of the connection means (either 20 or 21) is arranged to deform, by either contraction or expansion radially and/or along its axis, causing the threads to disengage and/or be sheared off, as a consequence of which the two cylinders will disengage and be separated. As a variant on this arrangement, both co-operative parts of the connection means may be formed from SMAs and be arranged such that, upon heating or cooling, one of the threads expands radially and the other contracts radially, to more readily afford separation of the two.

In the embodiment of FIG. 4*a* there is shown an SMA cutting device. A section of thin walled (typically aluminium alloy) rocket motor case (22) is shown, which has a series of windings of (stretched) SMA wire (24) around one part of the rocket motor case (alternatively (24) could be a solid annulus or collar formed from an SMA). The motor case including the SMA winding or collar (24) is then overwound with a reinforcing fibre (23), which may be an aramid (e.g. Kevlar) or carbon fibre. When the SMA wire (24) is subjected to heating through the transition temperature range of the SMA alloy, the wire (24) will contract along its length and hence the winding will contract radially either simply cutting the rocket motor case (FIG. 4*b*) or causing it to buckle and crack.

In this way the pressure build-up in the casing as a result of a subsequent cook-off event is avoided. Alternatively instead of using wire, a solid collar or ring of SMA can be used. If the SMA is previously expanded at the appropriate temperature for imparting "memory", it will contract when heated through the transition temperature range for the specific SMA being used.

The stress strain curve of FIG. 5 shows that as a load is applied to an SMA wire material, ie a tension force is applied, the stress and strain both increase. A strain induced phase transition occurs in region (30). The application of a further load past point 32 and further up line 33 imparts a 'memory' or 'work' into the alloy, such that upon eventual release of the load, the material will contract along line 31. Therefore when winding the wire onto a casing, one can either apply a load sufficient to take the SMA past point 32, or alternatively the wire can be pretensioned past point 32 and then wound under a reduced tension.

In an embodiment of the wire winding arrangement of the invention shown in FIG. 6, a housing (40) to contain the SMA wire (41) is shown as viewed from along the axis of the munition and located around the casing of the munition (45) (shown in section). The housing may extend either partially (not shown) or substantially fully around the casing. By arranging that the housing extends only partially around the casing, it can be ensured that the gap (52) between the ends of the housing does not fully close upon contraction of the wire (41). To further reduce the flexural stiffness of the housing, a series of notches (53) may be incorporated in the walls thereof, to allow the housing to bend and therefore curve more easily around the perimeter of the casing during the contraction of the wire, such that substantially all of the force being exerted by the wire is directed towards rupturing the case.

A section through the housing taken on a plane that is radial with respect to the munition casing is shown in FIG. 7 and the housing is seen to contain a plurality of SMA wire windings (41). The housing comprises a channel member and optionally flanges (44) which extend laterally of the channel member, as shown also in FIG. 7. The external shape of the housing is selected to give an effective cutting action. Thus in FIG. 7 the housing (40) is shown as being substantially square/rectangular in cross section with walls (42) to retain the wire (41) and a base (43) which is seated against the casing of the munition (45). For ease of winding the wire, the internal profile of the base of the housing may be rounded in cross section, such as typically a U-shape so as to give a smooth profile at the junction of the walls (42) and the base (43). As the wire contracts the greatest cutting force is exerted either across the region of the gap (52) between parts of the housing, where the wire (41) comes into direct contact with the casing (45), or in the alternative arrangement where the housing is a combination of flanged (61, 62) and unflanged (63) regions and the cutting occurs in the unflanged (63) region.

FIG. 8 shows the inward displacement of the non-flanged region of the embodiment of FIG. 6 after activation of the SMA. The gap (52) in this arrangement may be reduced in length, such that only a minimum amount of wire (41) is in contact with the case, so that the cutting force is then concentrated instead across the non-flanged region (63), as shown in FIG. 8.

In the embodiment of FIG. 9, there is shown one of the rupture failure mechanisms, where a wire is located in a housing (not shown), or is applied directly to the casing (45) (as shown in FIG. 4) and causes the casing to buckle or crumple. The failure point, or crack (71) occurs on the inside surface (72) of the casing (45) which is the point of greatest tensile stress. The failure point will then propagate radially outwards to the outside of the case (73) to produce a complete perforation of the case. As further load is applied to the perforation, the crack will tend to elongate along the length of the casing. In a slow cook-off incident, once the crack has perforated the case, the built up pressure from the energetic material (not shown) as it degrades, will assist in further elongating the perforation.

In certain situations the 'heat soak' effect described previously may be utilised to cause the automatic rupturing of the rocket motor case at an appropriate point in its flight.

Alternatively, the use of an SMA collar or wire overwinding could be applied to a lightweight launch tube for missiles and hence the component 22 in FIG. 4 could be such a launch tube instead of a rocket motor case.

EXAMPLE

A length of Ti—Ni wire 0.125 mm in diameter, was stretched by 9% to impart a memory and was then cut into 1 metre lengths. Separate lengths were hung vertically with weights of 0.55 Kg (corresponding to a tensile stress of 448 MPa in the wire), 0.75 kg (corresponding to 611 MPa) and 1.00 Kg (corresponding to 815 MPa) suspended from them. The wires were heated by the application of a current and the resulting recovery compressive strain (under load) measured. Respective length contractions corresponding to recovery strains of 7.1%, 5.9% and 4.9% were recorded, showing that considerable displacements can be achieved even when the stress opposing the contraction of the wire is as high as 815 MPa.

The invention claimed is:

1. A munitions casing comprising an annulus of a shape memory alloy disposed around said casing which shape memory alloy has been subjected to a combination of mechanical and thermal treatments so as to impart a memory wherein upon subsequent heating to a predetermined temperature, said memory causes said annulus to contract radially inwardly and rupture the said munitions casing.

2. The casing as claimed in claim 1, wherein the shape memory alloy is selected from Cu—Al—Zn, Cu—Al—Ni, Cu—Ni—Al—Zn—Mn, Cu—Zn—Al—Mn and Ti—Ni alloys.

3. The casing as claimed in claim 1 wherein the annulus is a wire winding and is wound within a housing which is located around the casing.

4. The casing as claimed in claim 3 wherein the housing extends wholly or partly around the perimeter of the monition casing.

5. The A casing as claimed in either claim 3, wherein the housing is U-shaped or rectangular in cross section.

6. The A casing as claimed in claim 5, wherein part of the length of the housing is provided with a flange which extends laterally on each side of the base of the housing.

7. The casing as claimed in claim 3, wherein the walls of the housing are cut to provide reduced flexural stiffness.

8. A method of using a munitions casing as clamed in claim 1 comprising locating the annulus, around the outer surface of the munitions casing and arranging for an internal heater to be applied to said at least one annulus, wherein the internal heater is capable of providing subsequent heating to the predetermined temperature so as to cause the annulus to rupture the munitions casing.

9. The casing as claimed in claim 1, wherein the shape memory alloy has a transition temperature range which lies in the range of 80°C -150°C.

10. The casing as clamed in claim 1, wherein the annulus is comprised of a plurality of windings of shape memory alloy in wire form.

11. The casing as claimed in claim 1 which is a casing for a shell, bomb, torpedo, missile or rocket motor.

12. The casing as claimed in claim 11, wherein the munitions casing is an overwound munition.

13. The casing as claimed in claim 11 containing an energetic material.

14. The casing as claimed in claims 13 wherein the energetic material is propellant or high explosive.

15. The casing as claimed in claim 1, which forms part of a launch tube assembly.

16. A method of manufacturing a munitions casing as claimed in claim 1, wherein the annulus of the shape memory alloy is i) subjected to a combination of mechanical and thermal treatments and is selected to have a composition such that, when installed around the munitions casing and subjected to subsequent heating to a predetermined temperature, said annulus will contract radially inwardly and rupture the said munitions casing; and ii) installing the pretreated annulus of the shape memory alloy around the munitions casing.

17. The method of claim 16 wherein the shape memory alloy that forms the annulus is stretched or expanded at a temperature below the predetermined temperature prior to fitting on the munitions casing.

18. The casing as claimed in claim 1, wherein the annulus is comprised of a solid ring of shape memory alloy.

* * * * *